US006962133B2

(12) United States Patent
Ogawa

(10) Patent No.: US 6,962,133 B2
(45) Date of Patent: Nov. 8, 2005

(54) VARIABLE VALVE TIMING CONTROL DEVICE

(75) Inventor: Kazumi Ogawa, Toyota (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 10/894,033

(22) Filed: Jul. 20, 2004

(65) Prior Publication Data

US 2005/0016483 A1 Jan. 27, 2005

(30) Foreign Application Priority Data

Jul. 22, 2003 (JP) ..... 2003-199964

(51) Int. Cl.[7] ..... F01L 1/34

(52) U.S. Cl. ..... 123/90.17; 123/90.15; 123/90.16; 123/90.31; 464/1; 464/2; 464/160; 92/5 L

(58) Field of Search ..... 123/90.17; 92/5 L

(56) References Cited

U.S. PATENT DOCUMENTS 6,439,181 B1 * 8/2002 Fujiwaki et al. ..... 123/90.17
6,651,600 B1 * 11/2003 Schafer et al. ..... 123/90.17
6,769,386 B2 * 8/2004 Shafer et al. ..... 123/90.17

FOREIGN PATENT DOCUMENTS

JP 2001-3716 6/1999

* cited by examiner

*Primary Examiner*—Thomas Denion
*Assistant Examiner*—Kyle M. Riddle
(74) *Attorney, Agent, or Firm*—Reed Smith LLP; Stanley P. Fisher, Esq.; Juan Carlos A. Marquez, Esq.

(57) ABSTRACT

A variable valve timing control device comprises a housing member integrally rotating with either one of a crankshaft or a camshaft of an internal combustion engine, a rotor member assembled to the housing member so as to be rotatable relative thereto, including at least one of vane portions forming an advanced angle chamber and a retarded angle chamber within the housing member, and integrally rotating with the other one of the crankshaft or the camshaft; a fluid pressure circuit for controlling operation fluid to be supplied to or discharged from the advanced angle chamber and the retarded angle chamber, an engaging groove formed at the housing member in circumferential direction and including an advanced angle side end portion and a retarded angle side end portion, a lock member provided at the housing member and being freely projecting/retreating, and a projecting portion provided at the rotor member and projecting outward, which is sandwiched between either one of the end portions of the engaging groove and the lock member being in a projecting state.

18 Claims, 4 Drawing Sheets

VARIABLE VALVE TIMING CONTROL DEVICE

CROSS REFERENCE TO RELATED APPLICATIONS

This application is based on and claims priority under 35 U.S.C. § 119 to Japanese Patent Application 2003-199964, filed on Jul. 22, 2003, the entire content of which is incorporated herein by reference.

FIELD OF THE INVENTION

This invention generally relates to a variable valve timing control device. More particularly, the present invention pertains to a variable valve timing control device for controlling an opening and closing timing of intake and exhaust valves of an internal combustion engine.

BACKGROUND

A known variable valve timing control devices is disclosed in Japanese Patent Laid-open published as JP2001-3716A2. The disclosed variable valve timing control device includes a housing member integrally rotating with a crankshaft of an internal combustion engine, a rotor member assembled to the housing member so as to be rotatable relative thereto, including vane portions forming an advanced angle chamber and a retarded angle chamber within the housing member, and integrally rotating with the camshaft. The variable valve timing control device also includes a fluid pressure circuit for controlling operation oil to be supplied to or discharged from the advanced angle chamber or the retarded angle chamber. The variable valve timing control device further includes a lock mechanism including a lock groove provided at the rotor member and a lock member being freely projecting/retreating and provided at the housing member. The relative rotation between the housing member and the rotor member is restricted when the lock member is projected and engaged with the lock groove. On the other hand, the relative rotation between the housing member and the rotor member is permitted when the lock member is retracted and disengaged from the lock groove.

According to such known variable valve timing control device, the lock groove is formed at inner side in the radial direction of the rotor member, and a bolt used for attaching the rotor member to the camshaft is provided at the center portion of the rotor member. Further, an oil path is also provided at the center portion of the rotor member for communicative connecting the advanced angle chamber and an oil pressure source, and the retarded angle chamber and the oil pressure source.

In such configuration, a seal portion is short in radial direction of the housing member and the rotor portion, so that the lock member may be improperly operated because the operation oil applied to the lock member is leaked from the seal portion.

A need exists for a variable valve timing control system to include a lock mechanism preventing the improper operation of the lock mechanism due to the leaked operation oil by sealing between the housing member and the rotor member.

SUMMARY OF THE INVENTION

A variable valve timing control device comprises a housing member integrally rotating with either one of a crankshaft or a camshaft of an internal combustion engine, a rotor member assembled to the housing member so as to be rotatable relative thereto, including at least one of vane portions forming an advanced angle chamber and a retarded angle chamber within the housing member, and integrally rotating with the other one of the crankshaft or the camshaft; a fluid pressure circuit for controlling operation fluid to be supplied to or discharged from the advanced angle chamber and the retarded angle chamber, an engaging groove formed at the housing member in circumferential direction and including an advanced angle side end portion and a retarded angle side end portion, a lock member provided at the housing member and being freely projecting/retreating, and a projecting portion provided at the rotor member and projecting outward, which is sandwiched between either one of the end portions of the engaging groove and the lock member being in a projecting state.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
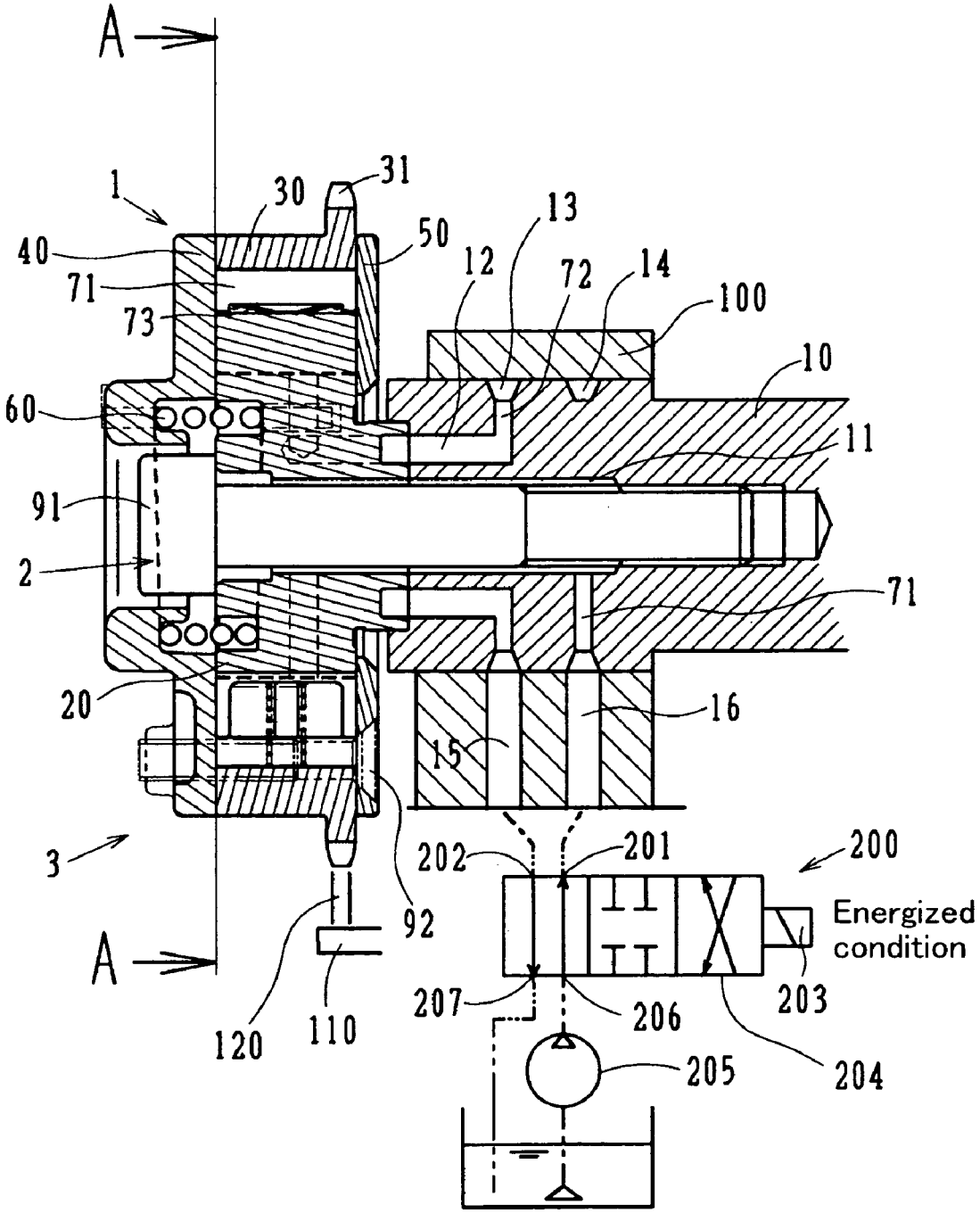
FIG. 1 is a longitudinal sectional view of a variable valve timing control device according to an embodiment of the present invention.

An embodiment of the present invention is explained referring to attached drawings. A variable valve timing control device 1 shown in FIG. 1 through 3 includes a rotor member 2 for opening/closing a valve, which includes a camshaft 10 rotatably supported on a cylinder head 100 of an internal combustion engine and an inner rotor 20 integrally fixed to a tip end portion of the camshaft 10. The variable valve timing control device 1 also includes a housing member 3 having an outer rotor 30 being rotatable relative to the inner rotor 20 within a predetermined range, a front plate 40 and a rear plate 50. A timing sprocket 31 is integrally formed on an outer periphery of the outer rotor 30. Further, the variable valve timing control device 1 includes a torsion spring 60 disposed between the inner rotor 20 and the front plate 40, four vanes 21 integrally formed to the inner rotor 20, a seal member 70 assembled to each vane 21, and a lock pin 80 (lock member) assembled to the outer rotor 30.

Figure 2:
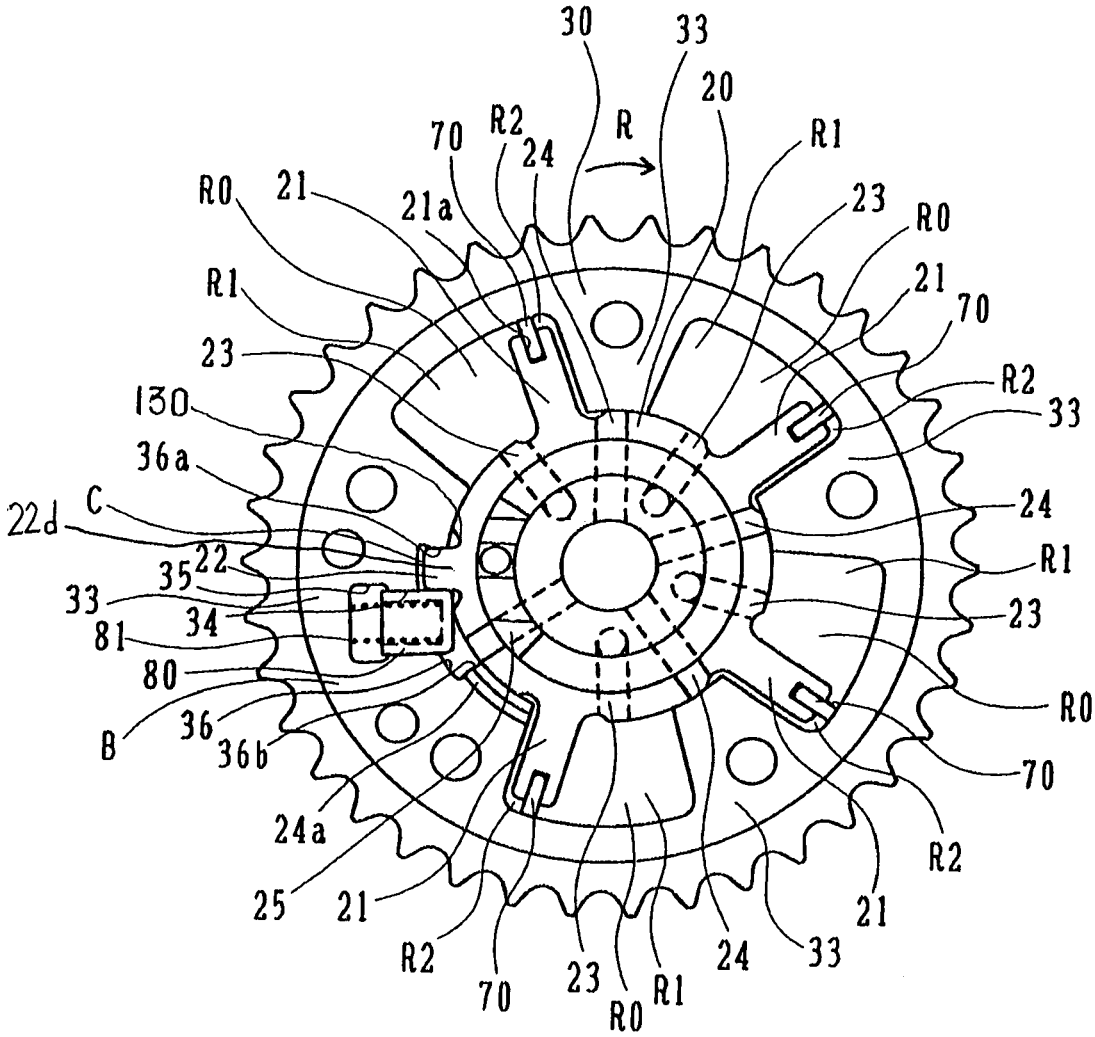
FIG. 2 is a cross-sectional view taken along the ling A—A of FIG. 1.

The timing sprocket 31 receives the rotation force in the clockwise direction thereof, which is shown as a rotation direction R of camshaft in FIG. 2. The rotation force is transmitted from a crankshaft 110 through a crank sprocket (not shown) and a timing chain 120.

The camshaft 10 includes a known cam (not shown) for opening/closing an exhaust valve (not shown). An advanced angle passage (fluid pressure circuit) 11 and a retarded angle passage (fluid pressure circuit) 12 extending in an axial direction of the camshaft 10 are provided inside of the camshaft 10. The advanced angle passage 11 is connected to a first connecting port 201 of a switching valve 200 through a passage 71 provided on the camshaft 10 in the radial direction thereof, an annular groove 14 provided on the camshaft 10 and a connecting passage 16 provided on the cylinder head 100. In addition, the retarded angle passage 12 is connected to a second connecting port 202 of the switching valve 200 through a passage 72 provided on the camshaft 10 in the radial direction thereof, an annular groove 13 provided on the camshaft 10 and a connecting passage 15 provided on the cylinder head 100.

The switching valve 200 has a known configuration in which a spool 204 is moved against a biasing force of a spring (not shown) by energizing a solenoid 203. When the solenoid 203 is de-energized, a supply port 206 connected to an oil pump 205 being driven by the internal combustion engine communicative connects with the second connecting port 202. At the same time, the first connecting port 201 communicative connects with a discharge port 207. When the solenoid 203 is energized, the supply port 206 communicative connects with the first connecting port 201 as shown in FIG. 1, and at the same time, the second connecting port 202 communicative connects with the discharge port 207. Therefore, in case that the solenoid 203 of the switching valve 200 is de-energized, the operation fluid (fluid pressure) is supplied to the advanced angle passage 11. In case that the solenoid 203 is energized, the operation fluid is supplied to the retarded angle passage 12. Energization of the solenoid 203 of the switching valve 200 is duty-controlled by which a ratio of energization/de-energization per unit time can be changed. For example, when the switching valve 200 is duty-controlled at 50%, the first and second ports 201 and 202, and the supply and discharge ports 206 and 207 are not communicative connected to each other.

The inner rotor 20 is integrally fixed to the camshaft 10 with an installation bolt 91. As shown in FIG. 2, four vanes 21 and projecting portions 22 extending in the radially outward direction are formed on the inner rotor 20. In addition, four advanced angle fluid passages 23 (fluid pressure circuit) extending in the radial direction of the inner rotor 20, three retarded angle fluid passages 24 (fluid pressure circuit) extending in the radial direction of the inner rotor 20, a fluid groove 24*a* (fluid pressure circuit), and a lock fluid passage 25 for communicative connecting a bottom portion 22*d* of the projecting portion 22 to the advanced angle passage 11.

As shown in FIG. 2, a seal groove 21*a* is formed at each vane 21 into which seal members 70 are inserted. The four vanes 21 are movably disposed within four fluid pressure chambers R0 which are formed between the outer rotor 30 and the inner rotor 20. Each vane 21 is positioned to divide each fluid pressure chamber R0 into an advanced angle chamber R1 and a retarded angle chamber R2. Each seal member 70 is biased in the radially outward direction by a vane spring 73 (shown in FIG. 1) disposed between the bottom portion of each seal groove 21*a* and the bottom face of each seal member 70. The vane spring 73 has a curved portion. The center portion of the vane spring 73 contacts with the bottom portion of the seal groove 21*a*. Both side portions of the vane spring 73 contact with the bottom face of the seal member 70.

As shown in FIG. 2, the operation fluid (fluid pressure) is supplied to or discharged from the four advanced angle chambers R1, which are separated by the vanes 21, through the advanced angle passage 11 and the advanced angle fluid passage 23. In addition, the operation fluid is supplied to or discharged from three retarded angle chambers R2 out of four through the retarded angle passage 12 and the retarded angle fluid passage 24. The operation fluid is supplied to or discharged from another retarded angle chamber R2 through a lock fluid passage 25 communicative connected to an engaging groove 36. The operation fluid is supplied to the retarded angle chamber R2 from the lock fluid passage 25 through the engaging groove 36 and the fluid groove 24*a*. Accordingly, for one retarded angle chamber R2 out of four, the retarded angle fluid passages 24 is not provided, and the lock fluid passage 25 is shared to be used, which may achieve a simple structure of the fluid pressure circuit.

One side of the outer rotor 30 in the axial direction thereof is integrally fixed to the annular shaped front plate 40, and the other side of the outer rotor 30 in the axial direction thereof is integrally fixed to the rear plate 50. The outer rotor 30, the front plate 40 and the rear plate 50 are connected with five connecting bolts 92. The timing sprocket 31 is integrally formed on an outer periphery of the outer rotor 30 and on an end side in the axial direction thereof to which the rear plate 50 is connected. In addition, four convex portions 33 are formed on the inner circumference of the outer rotor 30 in the circumferential direction thereof so as to be projecting in the radially inward direction. Each inner circumferential face of each convex portion 33 is slidably contacting with an outer circumferential face of the inner rotor 20. That is, the outer rotor 30 is rotatably supported on the inner rotor 20. The engaging grooves 36 in which the projecting portion 22 of the inner rotor 20 is housed are formed on one convex portion 33 out of the four. An advanced angle side end portion 36*a* of the engaging groove 36 engages with the projecting portion 22, thereby restricting a relative rotation angle between the outer rotor 30 and the inner rotor 20 toward the advanced angle side. In addition, a retarded angle side end portion 36*b* of the engaging groove 36 engages with the projecting portion 22, thereby restricting the relative rotation angle between the outer rotor 30 and the inner rotor 20 toward the retarded angle side. A retracting groove portion 34 for accommodating the lock pin 80, and a receiving bore 35 connected to the retracting groove portion 34 for accommodating a coil spring 81 that biases the lock pin 80 in the radially inward direction of the outer rotor 30 are formed on the engaging groove 36.

Figure 3:
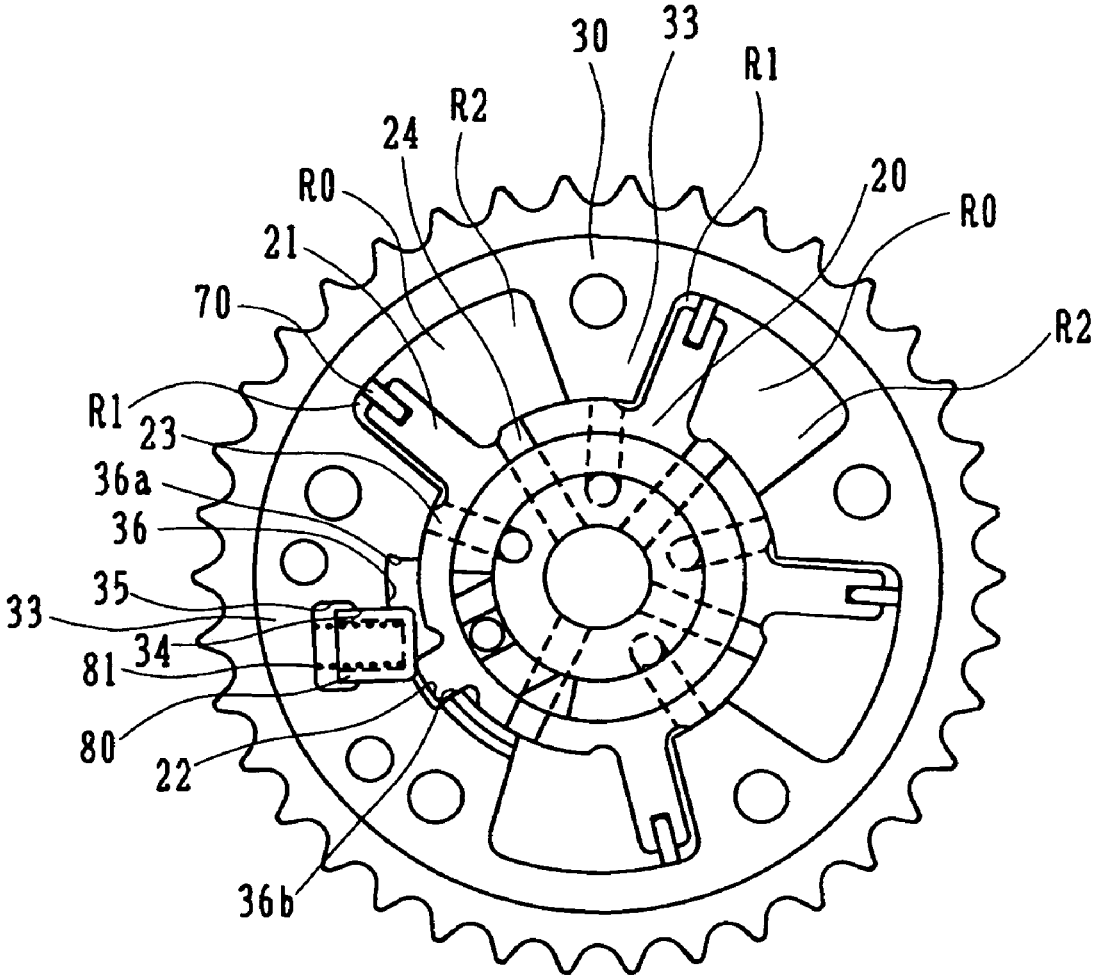
FIG. 3 is a cross-sectional view taken along the ling A—A of FIG. 1 at most retarded angle.
Figure 4:
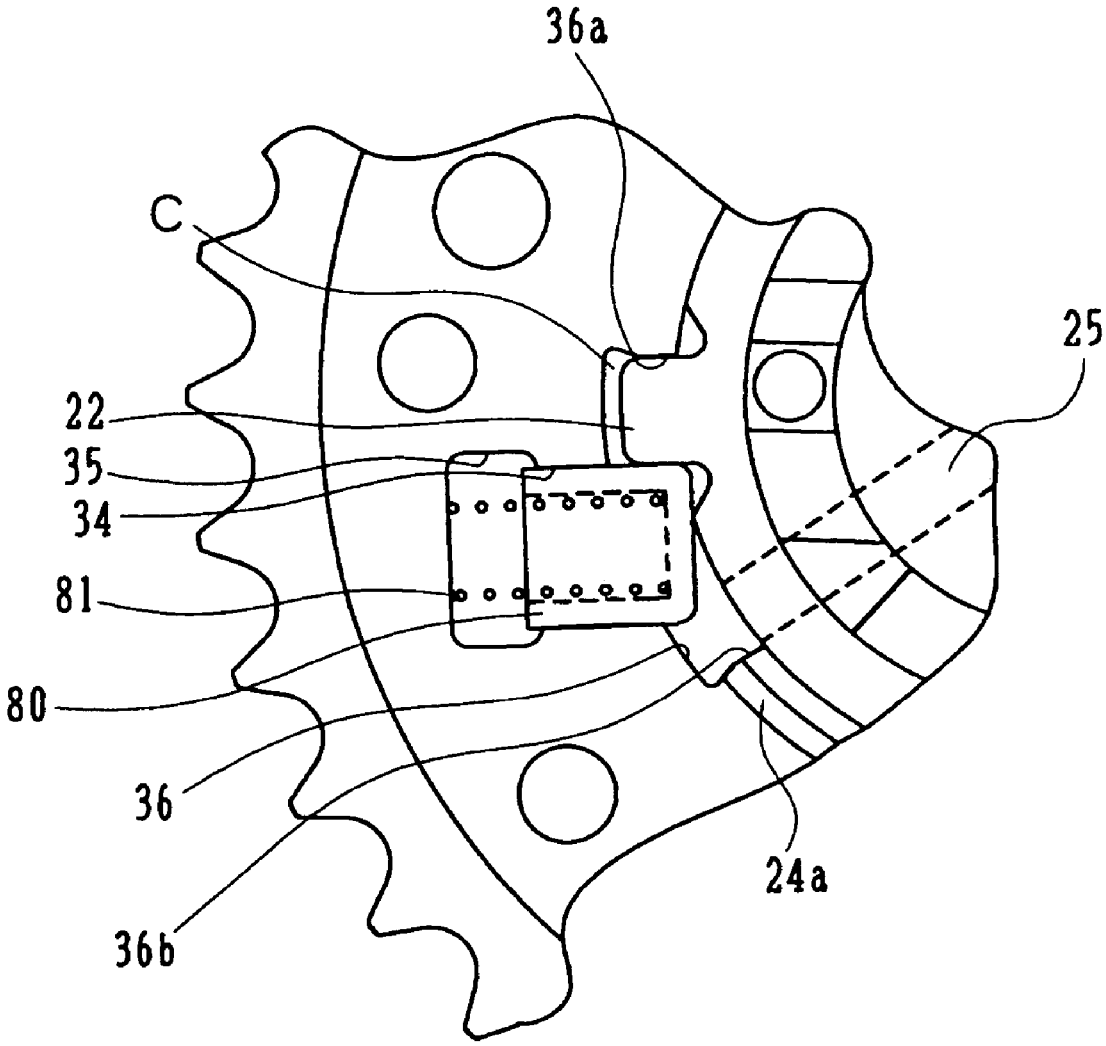
FIG. 4 is an enlarged view of B portion of FIG. 2.

As shown in FIG. 2 and FIG. 4, while the projecting portion 22 engages with the advanced angle side end portion 36*a*, the lock pin 80 is projected from the retracting groove portion 34, then the projecting portion 22 is sandwiched between the lock pin 80 and the advanced angle side end portion 36*a* so that the relative rotation is restricted at the most advanced angle position. Further, as shown in FIG. 3, a top portion of the lock pin 80 constantly engages with a tip portion of the projecting portion 22 while the relative rotation is not restricted (for example, the projecting portion 22 is at the most retarded angle position). In other word, the projecting portion 22 is not sandwiched between the lock pin 80 and the retarded angle side end portion 36*b*. Such configuration can prevent an error to restrict the relative rotation between the outer rotor 30 and the inner rotor 20. As shown in FIGS. 2–3, a distal surface of the lock pin 80 crosses a circular arc formed by a distal surface of the projecting portion 22. The lock pin 80 is gradually retreated from the engaging groove 36 by an engagement between the top portion of the lock pin 81 and a tip portion of the projecting portion 22, while the projecting portion 22 moves away from the advanced angle side end portion 36*a* towards the retarded angle side end portion 36*b*, As shown in FIG. 2, a notch 130 is formed at a base portion of the projecting portion 22 so as to prevent interference between the outer rotor 30 and the projecting portion 22 and secure the engagement therebetween, Further, a gap C is formed between the bottom portion of the engaging groove 36 and the tip portion of the projecting portion 22 as shown in FIG.

2 so as to permit a deformation of the projecting portion 22 and the engaging groove 36, which may interfere the relative rotation. Specifically, the interference of the relative rotation between the projecting portion 22 and the engaging groove 36 caused by the deformation due to a contact stress between the projecting portion 22 and the advanced angle side end portion 36*a*or the retarded angle side end portion 36*b*, or between the projecting portion 22 and the lock pin 80 by a torque fluctuation of the camshaft can be prevented by such gap C. In addition, there is no need to treat the projecting portion 22 with heat to prevent the deformation thereof so that a cost can be reduced, Further, the projecting/retreating direction of the lock pin 80 is decentering relative to the center point of the rotation of the housing member 3 so as to prevent the glitch of the lock pin 80 due to centrifugal force.

The torsion spring 60 is provided by engaging with the front plate 40 at one end and the inner rotor 20 at the other end, The torsion spring 60 biases the inner rotor 20 towards the advanced angle side (clockwise direction in FIG. 2) relative to the outer rotor 30, the front plate 40 and the rear plate so, Thus, the operation response of the inner rotor 20 to the advanced angle side may be improved.

According to the above-mentioned embodiment, when the internal combustion engine is stopped, the oil pump 205 is stopped, and also the switching valve 200 is not energized. Thus, the operation fluid is not supplied to the fluid pressure chambers R0. At this time, the lock pin 80 is projected from the retracting groove portion 34, and the projecting portion 22 of the inner rotor 20 is sandwiched between the lock pin 80 and the advanced angle side end portion 36*a* so that the relative rotation between the inner rotor 20 and the outer rotor 30 is maintained at the most advanced angle position. Even when the internal combustion engine is started and the oil pump 205 is driven, the operation fluid supplied from the oil pump 205 is only practically provided to the advanced angle chamber R1 through the connecting passage 16, the advanced angle passage 11 and the advanced angle fluid passages 23 while the duty ratio is small for energizing the switching valve 200 (i.e. the ratio of energizing time relative to the de-energizing time per unit time is small), Therefore, the variable valve timing control device 1 is maintained in a locked state.

When the retarded angle phase is required for the valve timing depending on the operation condition of the internal combustion engine, the duty ratio for energizing the switching valve 200 becomes large, then the position of the spool 204 is switched. The operation fluid supplied from the oil pump 205 is provided to the retarded angle chamber R2 through the connecting passage 15, the retarded angle passage 12 and the retarded angle fluid passage 24, or through the fluid groove 24*a* after supplied to the projecting portion 22 from the lock fluid passage 25. Therefore, the lock pin 80 is moved against the biasing force of the spring 81, thereby the head portion of the lock pin 80 is moved from the engaging groove 36. Then, the locked state between the inner rotor 20 and the outer rotor 30 is released, at the same time, the inner rotor 20 and each vane 21 integrally rotating with the camshaft 10 rotate relative to the outer rotor 30, the front plate 40 and the rear plate so in the retarded angle direction (counterclockwise direction in FIG. 2). Due to the aforementioned relative rotation, the timing of the cam is brought in the retarded angle state. Such relative rotation phase between the inner rotor 20 and the outer rotor 30 may be defined at an arbitrarily position, for example at an intermediate position by controlling the duty ratio of the switching valve 200.

Meanwhile, the operation fluid stored in the advanced angle chamber R1 is discharged from the discharge port 207 of the switching valve 200 through the advanced angle fluid passage 23, the advanced angle passage 11 and the connecting passage 16.

According to the aforementioned embodiment, the projecting portion provided at the rotor member and projecting outward is sandwiched between either one of the advanced angle side faces or the retarded angle side faces of the engaging groove formed at the housing member in circumferential direction, and the lock member being in a projecting state provided at the housing member and being freely projecting/retreating. Thus, an appropriate length of the seal portions of the housing member and the rotor member can be secured because of such engaging groove formed at the housing member so as to prevent the glitch of the lock mechanism.

Further, the top portion of the lock pin constantly engages with the tip portion of the projecting portion while the relative rotation is not restricted, in other word, the projecting portion is not sandwiched between the lock pin and the retarded angle side end portion. Such configuration can prevent an error of the restriction of the relative rotation between the outer rotor and the inner rotor.

In addition, the gap is formed between the bottom portion of the engaging groove and the tip portion of the projecting portion so as to prevent a deformation of the projecting portion and the engaging groove, which may interfere the relative rotation. Thus, there is no need to treat the projecting portion with heat to prevent the deformation thereof so that a cost can be reduced.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

What is claimed is:

1. A variable valve timing control device comprising:

a housing member integrally rotating with one of a crankshaft and a camshaft of an internal combustion engine;

a rotor member assembled to the housing member so as to be rotatable relative thereto, including at least one of vane portions forming an advanced angle chamber and a retarded angle chamber within the housing member, and integrally rotating with the other of the crankshaft and the camshaft;

a fluid pressure circuit for controlling operation fluid to be supplied to or discharged from the advanced angle chamber and the retarded angle chamber;

an engaging groove formed at the housing member in circumferential direction and including an advanced angle side end portion and a retarded angle side end portion;

a retracting groove formed on the housing member and connected to the engaging groove;

a lock member provided at the retracting groove and being freely projecting/retreating, and a projecting portion provided at the rotor member and projecting outward, which is in a locked state when being sandwiched between one of the end portions of the engaging groove while the lock member being in a first projecting state, and which is in a unlocked state when contacting the other of the end portions of the engaging groove while the lock member being in a second projecting state, wherein the lock member is gradually retreated from the engaging groove by an engagement between a top portion of the lock member and a top portion of the projecting portion, while the projecting portion moves away from said one of the end portions of the engaging groove towards said the other of the end portions of the engaging groove.

2. A variable valve timing control device according to claim 1, wherein a top portion of the lock member constantly engages with a tip portion of the projecting portion while the relative rotation between the housing member and the rotor member is not restricted.

3. A variable valve timing control device according to claim 1, wherein a gap is formed between a bottom portion of the engaging groove and the tip portion of the projecting portion.

4. A variable valve timing control device according to claim 2 wherein a gap is formed between a bottom portion of the engaging groove and the tip portion of the projecting portion.

5. A variable valve timing control device according to claim 1, wherein a projecting/retreating direction of the lock member is decentering relative to a center point of a rotation of the housing member.

6. A variable valve timing control device according to claim 2, wherein a projecting/retreating direction of the lock member is decentering relative to a center point of a rotation of the housing member.

7. A variable valve timing control device according to claim 3, wherein a projecting/retreating direction of the lock member is decentering relative to a center point of a rotation of the housing member.

8. A variable valve timing control device according to claim 4, wherein a projecting/retreating direction of the lock member is decentering relative to a center point of a rotation of the housing member.

9. A variable valve timing control device according to claim 1, wherein a notch is formed at a base portion of the projecting portion.

10. A variable valve timing control device according to claim 2, wherein a notch is formed at a base portion of the projecting portion.

11. A variable valve timing control device according to claim 3, wherein a notch is formed at a base portion of the projecting portion.

12. A variable valve timing control device according to claim 4, wherein a notch is formed at a base portion of the projecting portion.

13. A variable valve timing control device according to claim 5, wherein a notch is formed at a base portion of the projecting portion.

14. A variable valve timing control device according to claim 6, wherein a notch is formed at a base portion of the projecting portion.

15. A variable valve timing control device according to claim 7, wherein a notch is formed at a base portion of the projecting portion.

16. A variable valve timing control device according to claim 1, wherein said one of the end portions of the engaging groove is the advanced angle side end portion, and said the other of the end portions is the retarded angle side end portion.

17. A variable valve timing control device according to claim 1, wherein a distal surface of the lock member crosses a circular arc formed by a distal surface of the projecting portion.

18. A variable valve timing control device according to claim 16, wherein a distal surface of the lock member crosses a circular arc formed by a distal surface of the projecting portion.

* * * * *